US012071168B2

(12) United States Patent
Bunch et al.

(10) Patent No.: US 12,071,168 B2
(45) Date of Patent: Aug. 27, 2024

(54) CABLE CAR VERTICAL LOOP TRANSPORT SYSTEM

(71) Applicant: VERTICAL LOOP ENTERPRISES, LLC, Tenino, WA (US)

(72) Inventors: James K. Bunch, Arvada, CO (US); Jimmy Fletcher, Boulder, CO (US); Perry A. Shea, Tenino, WA (US)

(73) Assignee: VERTICAL LOOP ENTERPRISES, LLC, Tenino, WA (US)

( * ) Notice: Subject to any disclaimer, the term of this patent is extended or adjusted under 35 U.S.C. 154(b) by 677 days.

(21) Appl. No.: 16/566,623

(22) Filed: Sep. 10, 2019

(65) Prior Publication Data

US 2020/0079401 A1 Mar. 12, 2020

Related U.S. Application Data

(60) Provisional application No. 62/729,267, filed on Sep. 10, 2018.

(51) Int. Cl.
*B61B 7/04* (2006.01)

(52) U.S. Cl.
CPC ..... *B61B 7/04* (2013.01)

(58) Field of Classification Search
CPC ..... B61B 7/04; B61B 12/022
See application file for complete search history.

(56) References Cited

U.S. PATENT DOCUMENTS

| | | | | | |
|---|---|---|---|---|---|
| 4,848,241 | A * | 7/1989 | Kunczynski | B61B 7/04 | 104/173.1 |
| 4,864,937 | A * | 9/1989 | Kunczynski | B61B 7/04 | 104/173.1 |
| 4,998,482 | A * | 3/1991 | Kunczynski | B61B 12/02 | 198/712 |
| 5,069,140 | A * | 12/1991 | Glassey | B61B 12/022 | 104/173.2 |
| 5,172,640 | A * | 12/1992 | Cathiard | B61B 12/022 | 104/178 |
| 6,240,851 | B1 * | 6/2001 | Oudakker | B61B 13/10 | 104/127 |
| 6,363,858 | B1 * | 4/2002 | Voirin | B61B 7/04 | 104/173.1 |
| 7,832,339 | B2 * | 11/2010 | Richard | B61B 10/02 | 104/193 |
| 2007/0284219 | A1 * | 12/2007 | Michel | B61B 12/022 | 198/418 |
| 2012/0090494 | A1 * | 4/2012 | Beck | B61B 12/022 | 104/87 |
| 2017/0050646 | A1 * | 2/2017 | Blengini | B61B 7/06 | |
| 2018/0194371 | A1 * | 7/2018 | Richard | B61B 12/10 | |
| 2020/0079401 | A1 * | 3/2020 | Bunch | B61B 12/10 | |
| 2021/0024110 | A1 * | 1/2021 | Pfeifer | B61L 25/04 | |

* cited by examiner

*Primary Examiner* — Scott A Browne
(74) *Attorney, Agent, or Firm* — FisherBroyles, LLP

(57) ABSTRACT

A system, method and device for moving gondola cabins in a single vertical loop so as to pass above and below with end stations turning wheels placed vertically. The hauling ropes operate in a vertical loop and permit the vertical circulation of the cabins between stations with passenger boarding and deboarding of the cabins in the stations at two different levels. The system may be twinned to provide two parallel, horizontally adjacent systems operating on common towers to double the capacity of a single system. Both the single and twinned systems possess a smaller footprint than conventional horizontal transport systems.

6 Claims, 11 Drawing Sheets

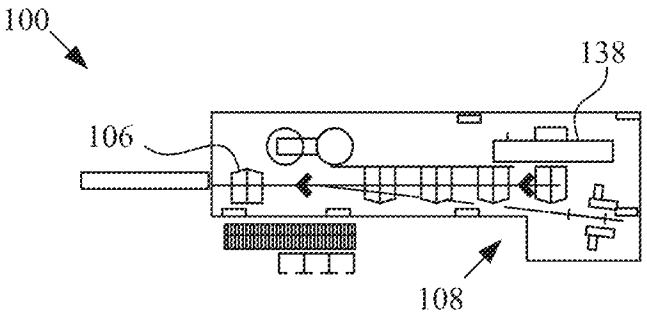
Fig. 4
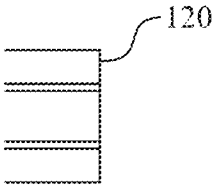

CABLE CAR VERTICAL LOOP TRANSPORT SYSTEM

PRIORITY CLAIM

This application claims priority from U.S. Provisional Application No. 62/729,267 filed on Sep. 10, 2018, which application is hereby incorporated by reference in its entirety as if fully set forth herein.

FIELD OF THE INVENTION

The present disclosure relates generally to high capacity transportation and, more particularly, to an aerial ropeway transportation system that can transport a large number of passengers in constrained environments while minimizing interference with existing infrastructures.

BACKGROUND OF THE INVENTION

Systems for mass transportation of passengers in urban environments are a common necessity. Ground-based or rail-based systems for moving people are expensive and have a very large footprint. Likewise, bus and water ferry systems require significant infrastructure and operating personnel and expense. Conventional gondola systems utilize a horizontal, side-by-side loop configuration for outgoing and incoming cabins (also referred to as cars). Such horizontal loop systems require significant horizontal spacing to accommodate the adjacent, side-by-side cables (also referred to as ropes) for the outgoing & incoming cabins and supporting structures. Such horizontal gondola systems are understandably difficult to install in existing urban areas where space is limited due to existing infrastructure. In addition, these conventional gondola systems do not offer the capacity needed for transporting large volumes of passengers. Accordingly, there is a need for a gondola system that is capable of mass transportation of people and has a small footprint, taking up minimal horizontal space both on and above the ground.

BRIEF DESCRIPTION OF THE DRAWINGS

Preferred and alternative examples of the present invention are described in detail below with reference to the following drawings:

FIG. 4 is a simplified plan view of the vertical loop transport system of FIG. 3;

DETAILED DESCRIPTION OF THE PREFERRED EMBODIMENT

Figure 1:
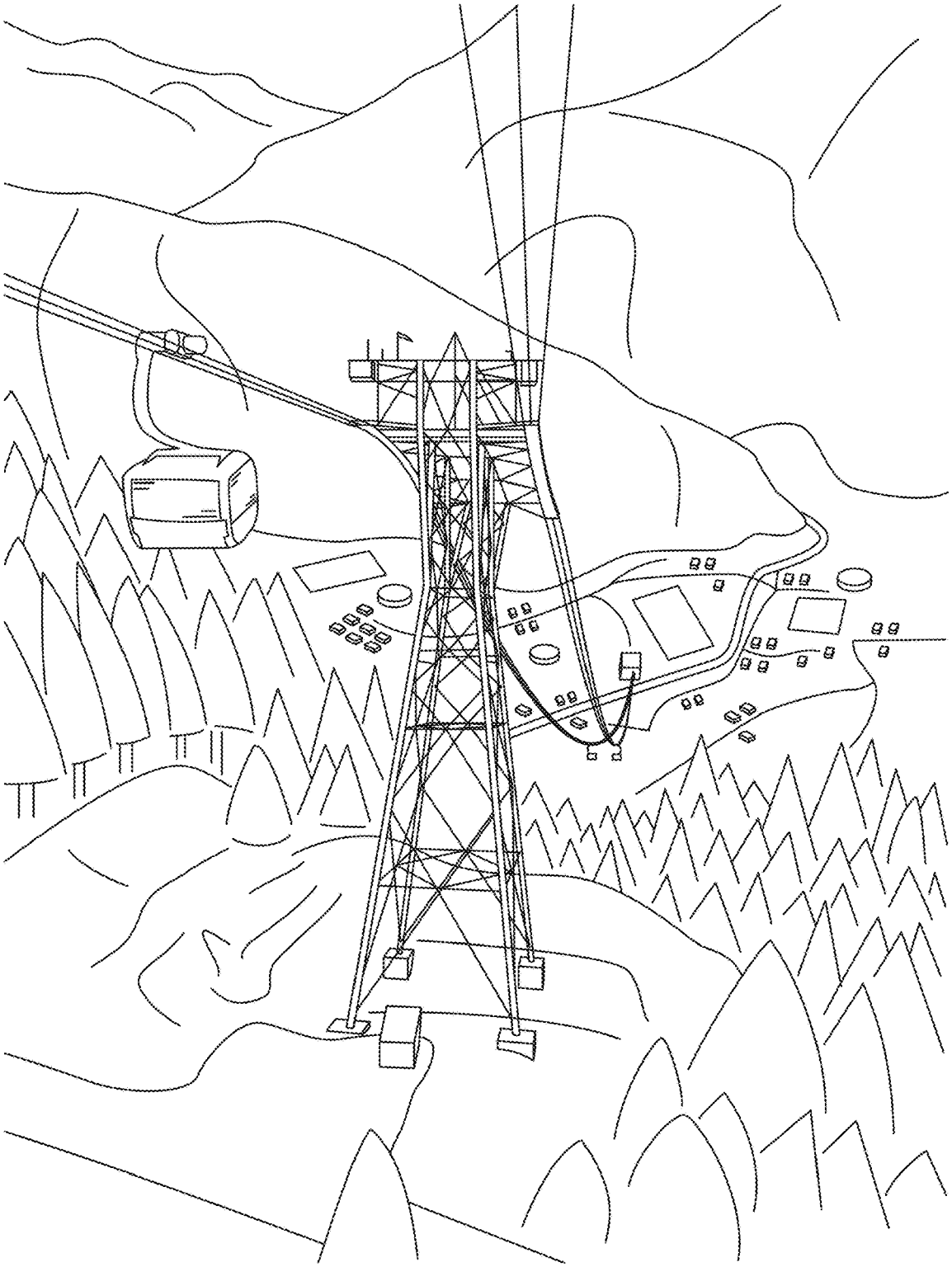
(PRIOR ART) Fig. 1
FIG. 1 illustrates a horizontal gondola transport system typical of the prior art.

Conventional gondola systems operate in a horizontal circulating mode with passengers loading and unloading at the same level regardless of the direction of travel. Such systems operating in urban environments do not provide the throughput capacity needed in heavily populated environments. FIG. 1 illustrates, by way of example, a typical horizontal gondola transportation system found in the prior art.

Figure 3:
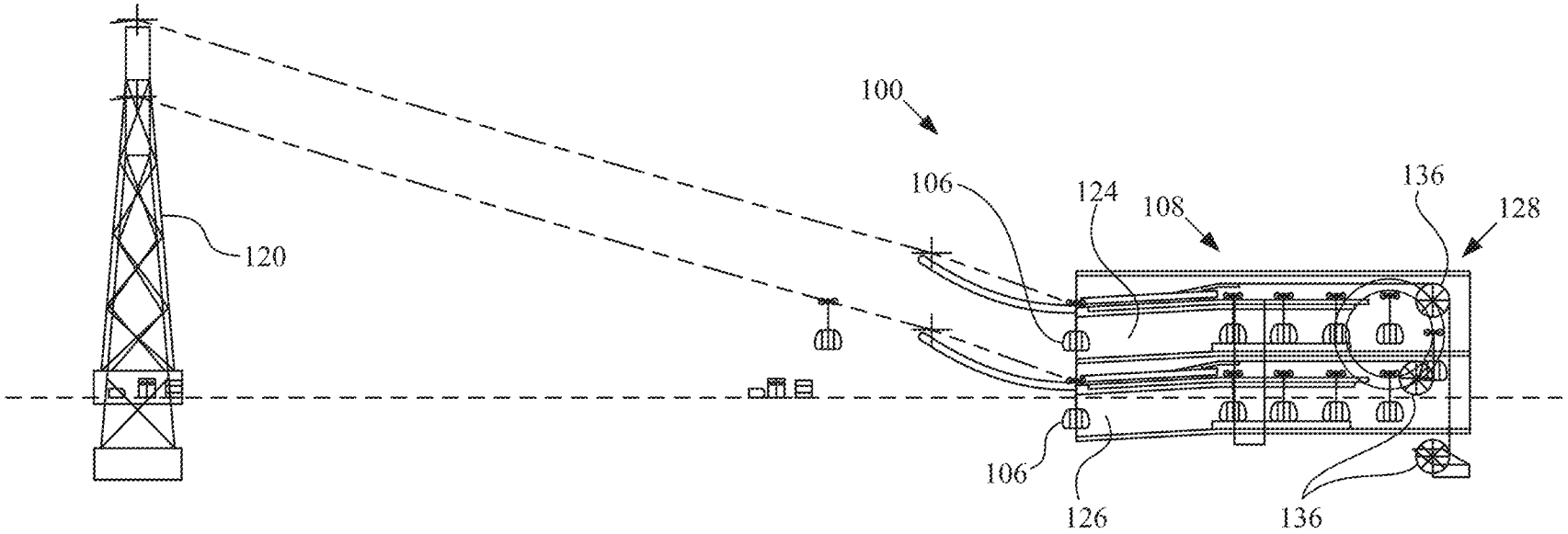
FIG. 3 is a simplified elevation view of the vertical loop transport system of FIG. 2.

In accordance with preferred and alternative embodiments and with reference to the figures, the present invention provides a system, method and device for moving gondola cabins 106 in a single vertical loop so as to pass above and below with end stations 108 turning wheels (FIG. 3) placed vertically. The hauling ropes (cables) operate in a vertical loop. For systems utilizing fixed support (track) ropes each level of cabins have independent track ropes. The stacking concept can be, for example, twinned to provide two parallel systems operating on common towers thus doubling the capacity of a single system.

Figure 2:
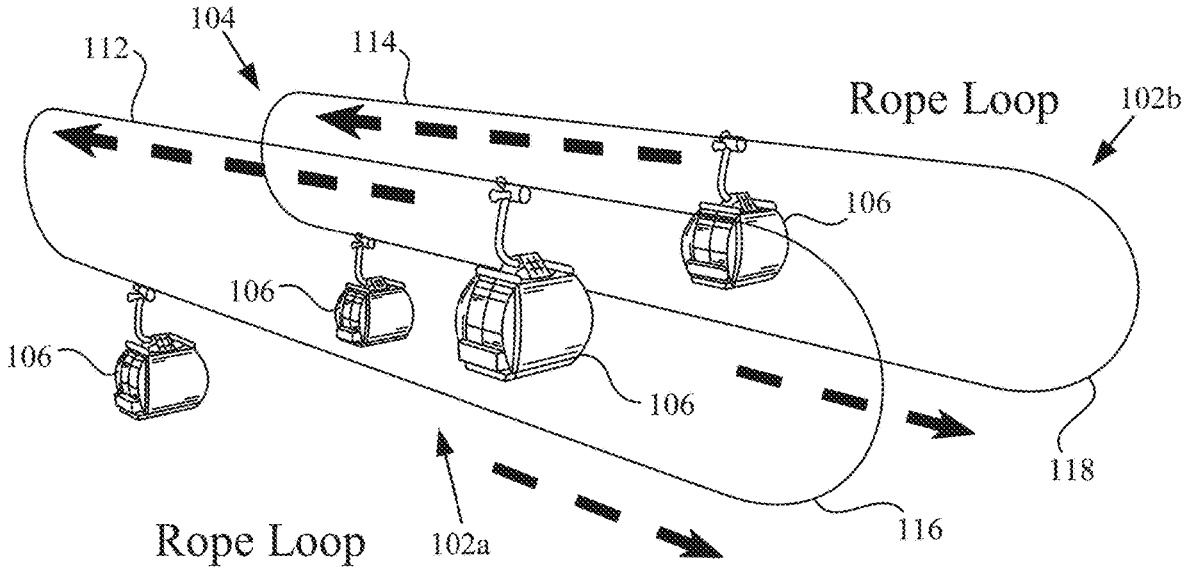
FIG. 2 is a schematic illustration of a vertical loop portion of a gondola transport system according to a preferred embodiment of the present invention.
Figure 5:
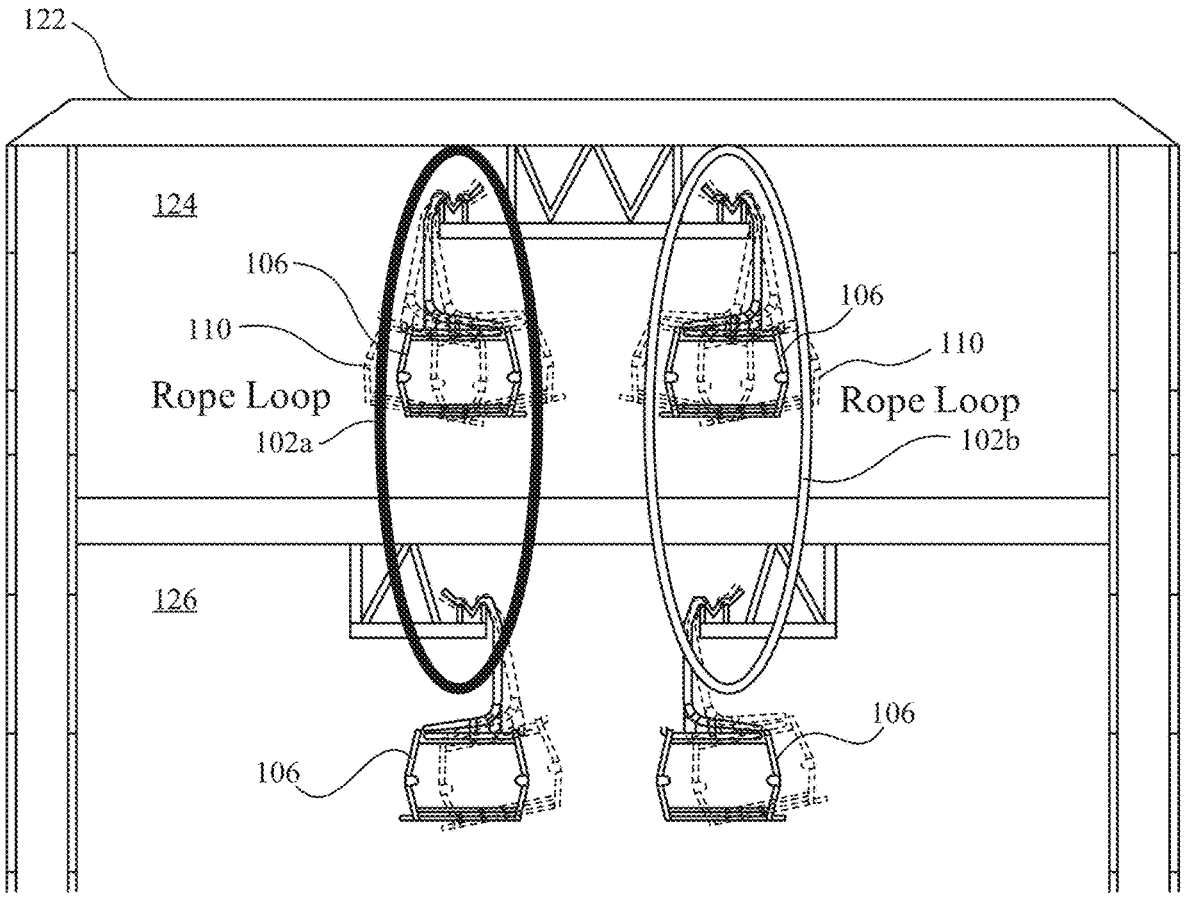
FIG. 5 is simplified elevation view an alternative embodiment of the gondola transport system depicting a double (twinned) arrangement having adjacent vertical loops.

In accordance with preferred and alternative embodiments, and as illustrated in FIGS. 2, 3, 5, 6A-6B and 7A-7B, a cable car vertical loop transport system 100 provides for the vertical circulation of the cable car cabins 106 between stations 108 with boarding and deboarding of the cabins 106 in the stations 108 at two different levels 124, 126. Providing this configuration as opposed to the standard horizontal loop, allows the vertical loop transport system 100 to operate in a much narrower corridor thus allowing for applications in dense urban environments. As illustrated in FIGS. 2 and 5, vertical loop system 100 may be implemented in either a single vertical loop (SVL) 102*a* or 102*b*, or double vertical loop (DVL) 104 (combined 102*a* and 102*b*) versions. Additionally, for example, by "twinning" (i.e., DVL) the system (100) operating in vertical parallel loops 104 (combined 102*a* and 102*b*), provide through-put capacities of up to 12,000 passengers per hour per direction.

Regarding the passenger capacity of system 100, the number of passengers per hour per direction (PPHPD) is a function of the capacity of each vehicle (also referred to herein as gondola or cabin) 106 and the time interval between vehicles 106 as expressed in the following relationship:

$$DC = C * \left(\frac{3600}{i}\right);$$

where "DC", represents design capacity, "C" is vehicle capacity and "i" is the time interval in seconds.

The individual vehicle capacity is determined from what system suppliers are willing to produce given the economics of the marketplace. The time interval between the vehicles 106 is selected based on the ability to load the number of passengers, C, into each vehicle. The ability to load this number of passengers is a function of the station design relative to the flow of passengers to/from the loading/unloading areas and the flow of passengers in close proximity to the vehicles 106 during the loading/unloading process. Other factors that influence through-put capacity include handling of non-ambulatory passengers; vertical circulation of passengers and ticket-checking. If the entire flow path of the passengers is not designed properly to handle the design capacity, DC, then the through-put capacity of system 100 will not be realized.

Factors to be considered in designing high-capacity systems, such as system 100, include cabin size; distance that the carrier hangs below the support ropes; code mandated carrier swing clearances and tower size and location. Other factors that affect the stacking (i.e., design) question are the height of buildings and other structures along the route; visual impacts of the support structures; utility infrastructure; the total height of the system; strategic location of tower support structures and resident privacy issues.

Intermediate support structures 120 (FIG. 3) along the alignment are in most cases located in the middle of the alignment of the circulating carriers. The structures 120 that are typically used are of the lattice type similar to power transmission towers. As the cabin size and support rope tension increase to accommodate higher capacities, the demands on the structures also increase and the individual structural elements of the towers 120 may utilize circular tube sections for increased strength.

The width of a station for a horizontal circulating system found in the prior art typically varies between seventy and eighty (70-80) feet depending on passenger handling. Therefore, to be able to operate two parallel or twined horizontal systems would require rights-of-way in excess of one hundred fifty (150) feet. On the other hand, the vertical loop system 100 providing the same capacity may operate in fifty (50)-foot-wide corridors using a straddle intermediate tower 122 as shown in FIG. 5.

In order to provide for swing clearance 110 (best illustrated in FIG. 5) and to minimize the interference of the towers 122 with the built urban infrastructure, support structures that span the street at strategic intersections are utilized. This type of support structure will necessitate that the cable car tower machinery will be "hung" from a horizontal girder above.

As best illustrated in FIG. 5 and in accordance with the preferred embodiment, a stacked (DVL) system 100 incorporates one vertical loop 102*a* on the left side and one vertical loop 102*b* on the right side. As illustrated in FIGS. 2, 5, 6C and 7C, both lines 112, 114 running in the same direction would be on the upper level 124 and both lines 116, 118 running in the other direction would be on the lower level 126. That way all passengers in the stations 108 going one direction would go to the same level 124, 126 and take either system 102*a*, 102*b* that is running.

The moving rope, or haul rope, 112, 114, 116, 118 for each system 102*a*, 102*b* of DVL system 100 passes into the terminal stations 108 and moves vertically at elevator 128 to the level above 124 or below 126. Bullwheels and drives are oriented vertically, which is not common in loop cable car systems. However, large single cabin tram systems are nearly all arranged with vertical bullwheels and therefore, this type of drive system is well understood and is not discussed in detail.

If there are intermediate stations 122, there will be no turnaround of carriers 106 at the intermediate stations 122. In many multi-section cable cars systems, each section is able to operate as a single section with a turnaround at each station. That design makes the station more complicated. In a system with large carrier components the switching and mechanical systems required are significant. In accordance with a preferred embodiment, the DVL system 104 of system 100 is designed so that if one section develops a problem, the rest of the line for that side 102*a*, 102*b* can be run into the stations 108 as the cabins 106 are parked and the passengers unloaded. The passengers can continue on the other (adjacent) system 102*a*, 102*b*. The two systems 102*a*, 102*b* of DVL system 100 are preferably completely separate physically and electrically such that there is no interaction, other than passenger loading.

The stacking (DVL) system 100 provides the advantage of being able to operate each of the systems 102*a*, 102*b* independently thus allowing for uninterrupted operation. For example, one system 102*a* or 102*b* can be completely taken out of service and safety maintained without interfering with the parallel operating system 102*b* or 102*a*. Additionally, passengers going in one direction will be vertically separated from passengers going in the other direction (FIGS. 2 and 5). Potentially, vertical circulation infrastructure, stairways; escalators and elevators, could be minimized by having the loading/unloading platforms in the middle of the stations.

In accordance with a preferred embodiment, the cabins 106 are transported vertically (for example, forty (40) feet at the terminal stations 108 at an interval spacing of 20 seconds. The various movements of the cabins 106 are best illustrated in FIGS. 6A-C, 7A-C. As the cabins 106 enter the terminal station 108, they slow down using standard mechanisms. Individual cabins 106 are conveyed on a standard rail system 130 to a waiting or "stow" position where a set of cabins (such as four (4) offered as a nonlimiting example) are collected in a stow area 132. At the appropriate sequencing interval, the set of cabins 106 are moved by a conveyor 142 comprising tires or wheels 144 (FIGS. 6C, 7C) onto a self-contained enclosure (elevator section) 128, that is preferably electronically secured with various safety system verifications and raised or lowered forty (40) feet. At this point the set of cabins 106 are moved from the self-contained enclosure (elevator section 128) and sequenced back into the moving rope loop 102*a*, 102*b* at the appropriate time interval which is a minimum of 20 seconds.

Figure 6A:
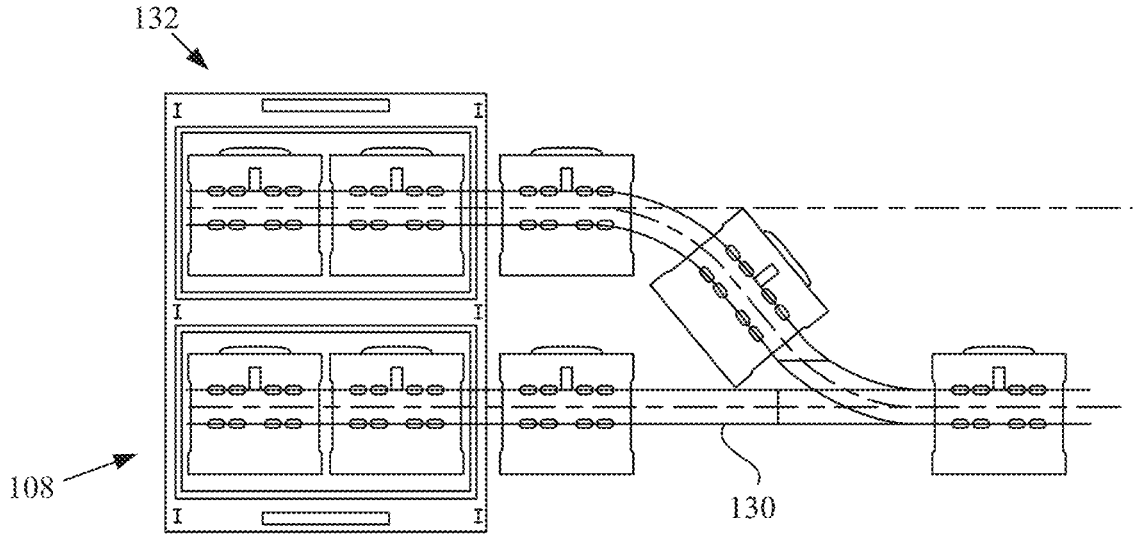
FIG. 6A is a partial plan view of a cabin hoist system according to an embodiment of the present invention.
Figure 6B:
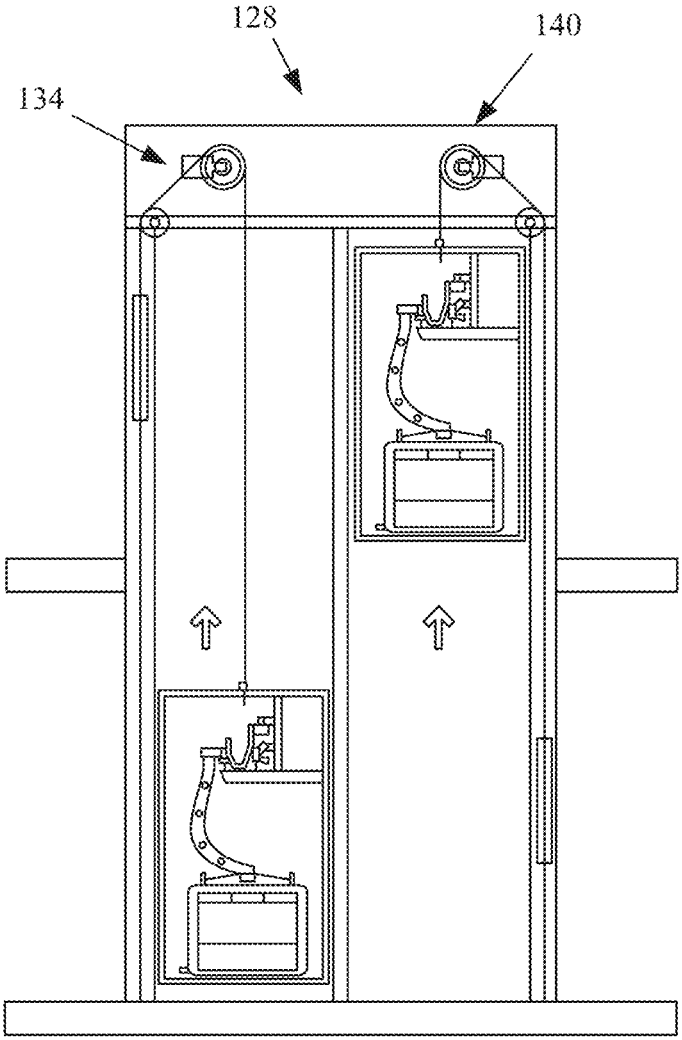
FIG. 6B is an end view elevation of the cabin hoist system of FIG. 6A.
Figure 6C:
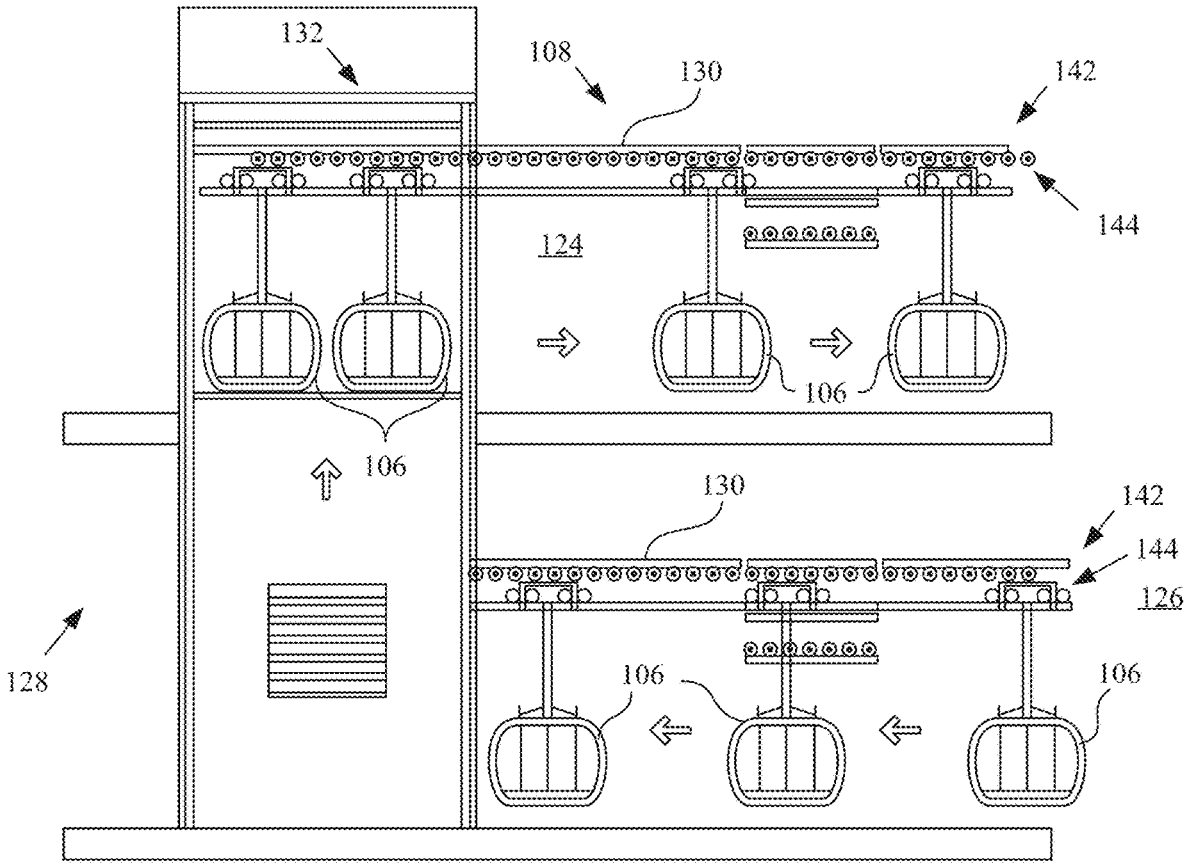
FIG. 6C is a side elevation of the cabin hoist system of FIG. 6A.
Figure 7A:
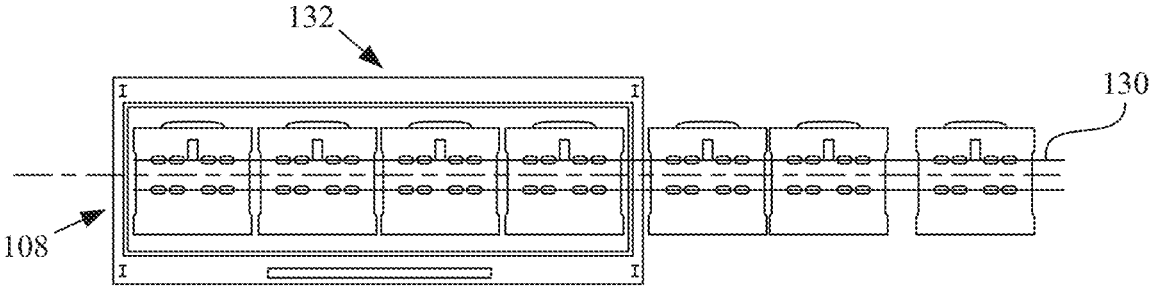
FIG. 7A is a partial plan view of a cabin hoist system according to an alternative embodiment of the present invention.
Figure 7B:
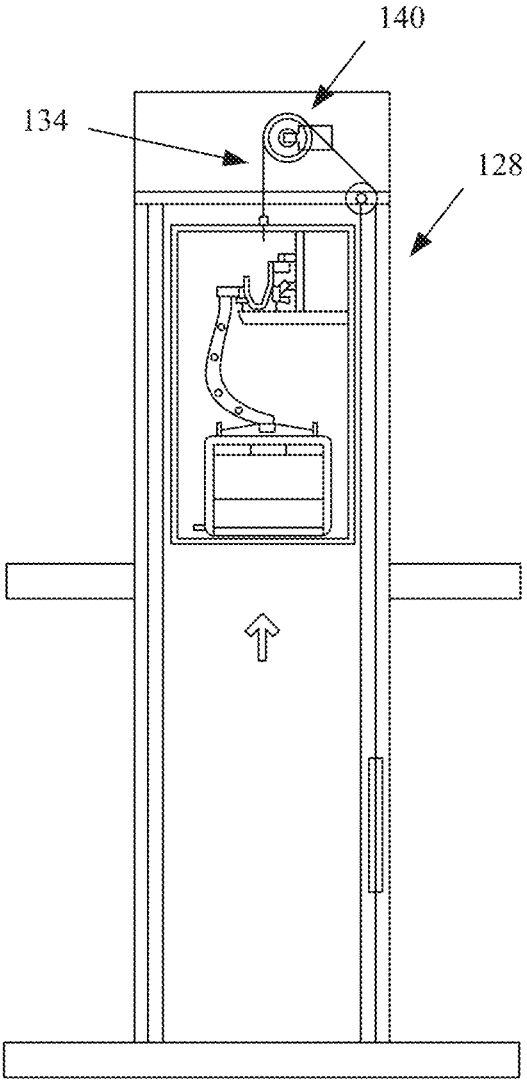
FIG. 7B is an end view elevation of the cabin hoist system of FIG. 7A; and, FIG. 7C is a side elevation of the cabin hoist system of FIG. 7A.
Figure 7C:
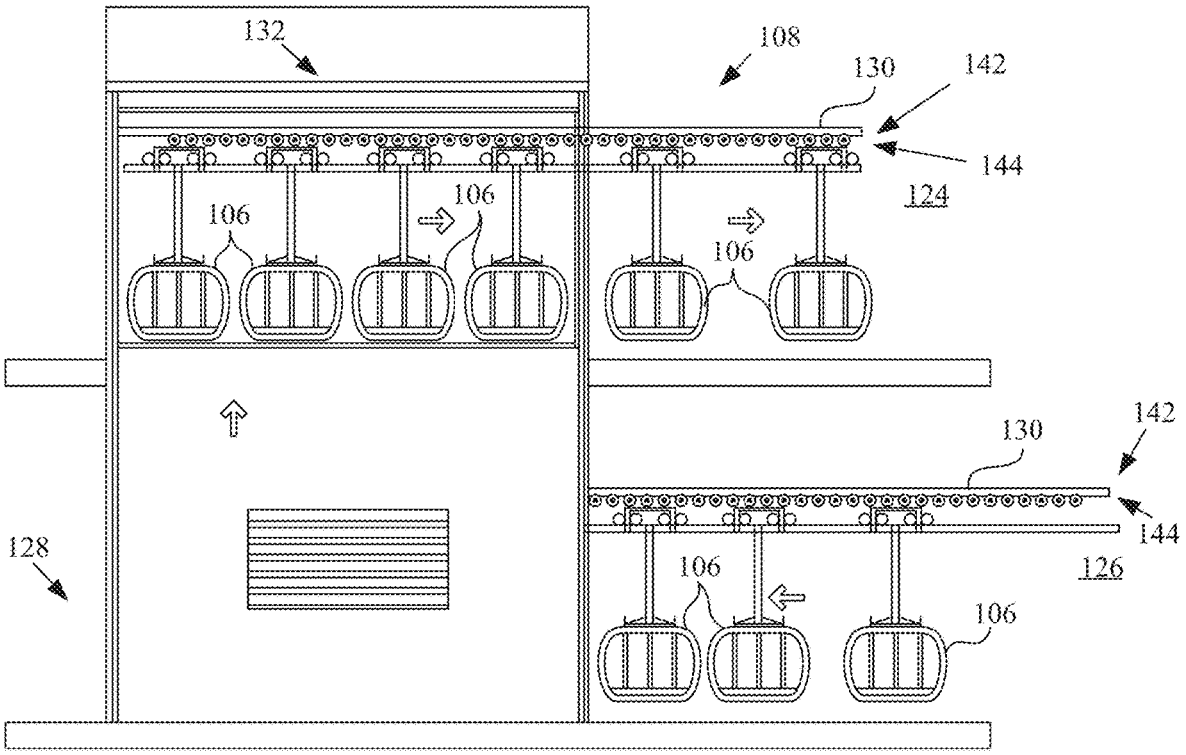

Referring to FIGS. 6A-C and 7A-C, system 100 utilizes either an in-line queueing of cabins 106 in the stow position 132 (FIGS. 7A-C) or a split queueing of cabins 106 with a switch before the stow position 132 (FIGS. 6A-C). The in-line queuing allows for the minimum cabin interval while eliminating the complexity of a switch whereas the split queueing provides redundancy and thus higher reliability. The inline queuing increases the total length of the station while the split queueing does not increase the overall width of the station due to space required for passenger loading and unloading. For ease of understanding, the system 100 illustrated in FIGS. 6A-C and 7A-C illustrates single vertical loop operation (e.g., 102*a*, 102*b*). Operating in the double loop configuration (DVL) system 100 provides a doubling of the throughput capacity while providing for continuous 24/7 passenger service.

The hoisting, switching and stowing sequencing may be adjusted and controlled to provide the necessary time steps to allow for the synchronization of the cabin movements needed between the upper loop section (112, 114) and the lower one (116, 118) assuming a minimum cabin interval of 20 seconds.

The vertical transfer system 100 meets safety and reliability requirements established by accepted automated people-mover and ropeway standards currently in use worldwide.

Features of the vertical loop transport system 100 include, but are not limited to:

Vertical loop circulating cabins,

Operating in narrow rights-of-way,

Ability to increase throughput capacity,

Vertical cabin transfer at terminal stations.

The vertical loop transport system 100 differs from conventional horizontal gondola systems at least in the following ways:

Continuous circulation of cabins in a vertical loop configuration,

The ability to vertically transfer the cabins at terminal stations at the desired operating interval.

By stacking a single system, two or more parallel systems can be operated in a narrow width of right-of-way thus doubling single system capacity thus providing 110,000 to 12,000 passengers per hour per direction.

In accordance with a further embodiment of the present invention, a method of transporting cable cars 106, comprises the steps of operating a vertical loop 102*a*, 102*b* supported from a support structure 108, operating the vertical loop 102*a*, 102*b* with a power supply, and moving a gondola cabin supported from the vertical loop. The method further comprises the steps of operating the vertical loop in a first direction at a first elevation, and operating the vertical loop in a second direction at a second elevation.

Ground-based or rail-based systems and methods that move a comparable volume of passengers typically cost ten (10) times more to implement and have a much larger footprint. In addition, with an aerial system and method, such as vertical loop transfer system 100, towers 122 can be located up to 4,000 feet apart thus minimizing disruption to existing infrastructure. In essence, the vertical loop transfer system 100 "flies" over what is on the ground or difficult terrain.

Various aspects of the present invention may be described in terms of functional components and various process steps. Such functional elements may be realized by any number of hardware or software components configured to perform the specified functions and achieve the various results. In addition, various aspects of the present invention may be practiced in conjunction with any number of computation components, and the systems and methods described are merely exemplary embodiments and applications of the present invention. In addition to a system and apparatus for providing vertical loop transportation for cable cars 100, also disclosed is a method for achieving the desired transportation operation.

The terms "comprise", "comprises", "comprising", "having", "including", "includes" or any variations of such terms, are intended to reference a non-exclusive inclusion, such that a process, method, article, composition, apparatus or system that comprises a list of elements does not include only those elements recited, but may also include other elements not expressly listed or inherent to such process, method, article, composition, apparatus or system. Other combinations and/or modifications of the above-described structures, arrangements, applications, proportions, elements, materials, components or steps used in the practice of the present invention, in addition to those not specifically recited, may be varied or otherwise particularly adapted to specific environments, manufacturing specifications, design parameters, or other operating requirements without departing from the general principles of the same.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A transportation system comprising:

a vertical loop supported by a support structure;

a power supply for moving the vertical loop;

at least one gondola cabin supported by the vertical loop; and a first end station comprising a passenger loading platform at a first elevation and configured to allow a passenger to enter the at least one gondola cabin, the first end station further comprising a passenger unloading platform at a second elevation and configured to allow a passenger to exit the at least one gondola cabin, the first elevation being different from the second elevation, wherein the first end station is further configured such that the at least one gondola cabin enters the first end station the second elevation and exits the first end station at the first elevation, the vertical loop operates in a first direction at the first elevation, and the vertical loop operates in a second direction at the second elevation.

2. The system of claim 1, wherein the first direction is opposite the second direction and the first elevation is above the second elevation.

3. The system of claim 2, wherein the vertical loop comprises a first end and a second end; and the system further comprises a second end station, the first end station located at the first end of the vertical loop and the second end station located at the second end of the vertical loop.

4. A method of transporting cable cars, comprising the steps of:

operating a vertical loop supported by a support structure;

operating the vertical loop with a power supply;

moving a gondola cabin supported by the vertical loop into a first end station comprising a passenger loading platform at a first elevation and configured to allow a passenger to enter the gondola cabin, the first end station further comprising a passenger unloading platform at a second elevation and configured to allow a passenger to exit the gondola cabin, the first elevation being different from the second elevation, wherein the gondola cabin enters the first end station at the second elevation and exits the first end station at the first elevation;

operating the vertical loop in a first direction at the first elevation; and operating the vertical loop in a second direction at the second elevation.

5. The system of claim 1, wherein the first end station comprises a single passenger loading platform and a single passenger unloading platform.

6. The system of claim 1, wherein the at least one gondola cabin comprises a plurality of gondola cabins, and wherein each gondola of the plurality travels within the first end station inline on the same vertical loop with respect to each other gondola of the plurality.

* * * * *